United States Patent [19]

Gohlke

[11] Patent Number: 4,967,527

[45] Date of Patent: Nov. 6, 1990

[54] EXPANSION JOINT FIRE BARRIER SYSTEMS

[75] Inventor: Henry J. Gohlke, Shawnee, Okla.

[73] Assignee: Metalines, Inc., Oklahoma City, Okla.

[21] Appl. No.: 919,753

[22] Filed: Oct. 16, 1986

Related U.S. Application Data

[63] Continuation-in-part of Ser. No. 778,852, Sep. 23, 1985.

[51] Int. Cl.[5] ..... E04B 1/68; E04B 1/94; E04F 15/14; G21F 1/12

[52] U.S. Cl. ..... 52/396; 52/573; 250/517.1; 250/519.1

[58] Field of Search ..... 428/645; 250/519.1, 250/515.1, 516.1, 517.1; 52/396, 573; 404/53, 54, 67, 68

[56] References Cited

U.S. PATENT DOCUMENTS

| | | | |
|---|---|---|---|
| 1,574,884 | 3/1926 | Hendricks | 250/515.1 |
| 1,854,942 | 4/1932 | Lapof | 250/517.1 |
| 3,394,639 | 7/1968 | Viehmann | 52/396 |
| 3,745,726 | 7/1973 | Thom | 52/573 |
| 4,347,285 | 8/1932 | Batdorf | 428/450 |
| 4,517,779 | 5/1985 | Dunsworth | 52/573 |
| 4,566,242 | 1/1986 | Dunsworth | 52/573 |
| 4,588,523 | 5/1986 | Tashlick et al. | 428/921 |

FOREIGN PATENT DOCUMENTS

| | | | |
|---|---|---|---|
| 626171 | 9/1978 | U.S.S.R. | 52/396 |
| 1434649 | 5/1976 | United Kingdom . | |

*Primary Examiner*—Michael Safavi

*Attorney, Agent, or Firm*—Laney, Dougherty, Hessin & Beavers

[57] ABSTRACT

Apparatus for fireproof and/or radiation resistant cover of expansion voids consisting of expansion joint cover structure spanning the expansion void and supporting at least one layer of stainless steel foil and/or lead foil and other refractory material in continual coverage across said void.

7 Claims, 5 Drawing Sheets

EXPANSION JOINT FIRE BARRIER SYSTEMS

CROSS-REFERENCE TO RELATED APPLICATION

The present application is a continuation-in-part of U.S. Pat. Application No. 778,852 entitled "Improvements in Expansion Joint Fire Barrier Systems: as filed on Sept. 23, 1985.

BACKGROUND OF THE INVENTION

1. Field of the Invention

The invention relates generally to expansion joint fire barrier systems and, more particularly, but not by way of limitation, it relates to an improved system that utilizes a combination of thin, relatively flexible stainless steel sheets with a fire resistant fiber composition in particularly folded and reinforced configuration, such barrier combinations being capable of installation in selected multiples at an expansion joint assembly.

2. Description of the Prior Art

The prior art includes several types of attempt at providing fire or smoke barriers across expansion joints, and some of these prior designs have been used in combination with forms of expansible joint. The U.S. Pat. No 4,517,779 in the name of Dunsworth, property of the present assignee, best characterizes the present state of the art as regards expansible fire barrier structure. This patent teaches an expansion joint assembly which includes a barrier box containing fire resistant, moisturized material, and the assembly is also utilized with an underlying expansible fire and smoke barrier comprised of METAFLEX TM, a coated silica fabric. Multi-foil type thermal insulation materials have also been utilized in the past in such as radioisotope power systems. Aluminum, copper and nickel foil radiation shields have been utilized in combination with fibrous spacers in the form of plain and metal-flake opacified papers with woven fabrics selected to separate the separate radiation shields. Foil thermal radiation shields of brass, chromium, silver and gold have also been explored with varying success.

More particular to the area of building materials, a relatively thin, flexible sheeting has been constructed containing sodium silicate, glass fiber and a wire netting core. The sheeting is then coated on both sides with an epoxy resin suitable for exclusion of atmosphere and particularly carbon dioxide. A number of other materials are known for their fire resistant quality whether inherently combustion resistant or acquisitive of fire resistance characteristics through particular structural layering or assembly characteristics.

SUMMARY OF THE INVENTION

The present invention relates to improvements in fire resistant expansion joint structure, which improvements are largely directed to the inclusion of a flexible fire and smoke barrier assembly that is formed of stainless steel sheet and which may include additional fire-resistant fibrous material layered therewith. The expansion assembly includes oppositely disposed support structures in secure affixure on opposite sides of an expansion void and a centered expansion cover plate in operative association therewith. A fire and smoke barrier consisting of layered fire-resistant fibrous material and stainless steel sheeting is then rigidly secured across the void between the opposed shoulder support structures, the barrier including enough flexible expanse to continually enclose over the expansion void at both limits. Radiation shielding may also be provided by inclusion of suitable expanses of lead foil or sheeting. The stainless steel sheeting or foil and fibrous insulation material are utilized in varying folded and/or spaced configurations, depending upon exigencies of application, and bonded reinforcing or securing rod may be used to form gripping edge configurations.

Therefore, it is an object of the present invention to provide an expansion joint barrier that exhibits greater isolation from fire, heat and smoke.

It is also an object of the invention to provide an expansion joint assembly that may be employed across a building expansion void with the capability of completely isolating a fire condition.

It is still further an object of the invention to provide an expansion joint enclosure that exhibits versatile radiation shielding including high energy radiation and particle blockage.

It is yet another object of the present invention to provide an expansion joint fire barrier system that exhibits reliable and long-life usage.

Finally, it is an object of the present invention to provide an expansible fire and smoke barrier system that is employable in various fold plys and package configurations in accordance with the exigencies of the installation.

Other objects and advantages of the invention will be evident from the following detailed description when read in conjunction with the accompanying drawings which illustrate the invention.

DETAILED DESCRIPTION OF THE INVENTION

Figure 1:
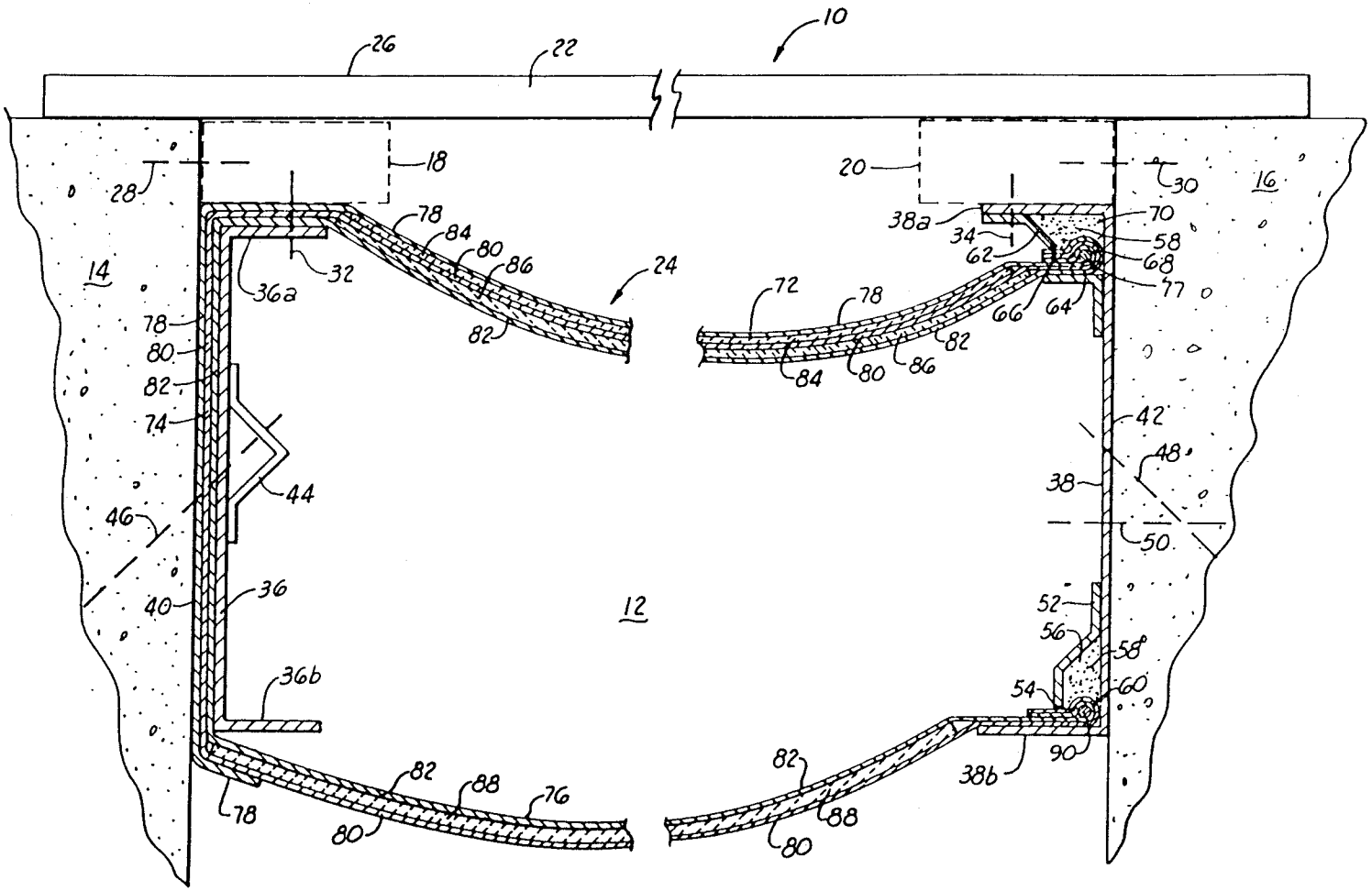
FIG. 1 is a view in vertical section and partial block form of an expansion joint assembly with fireproof barrier as constructed in accordance with the present invention.

Referring to FIG. 1, a fireproof expansion joint assembly 10 is illustrated as it is operatively positioned to enclose an expansion void 12 disposed between shoulder supports 18 and 20 of adjacent building structures 14 and 16, e.g. adjoining building exterior walls, interior walls, floor sections or the like wherein expansion displacement must be accounted for. The expansion joint assembly 10 may be used on either the interior or exterior to counter expansion shifts due to wind sway, seismic disturbance, vibration or other moving forces while also including an added fire barrier structure 24 in plural folds of multiple plys.

The basic expansion joint assembly is a type consisting of the shoulder sub-assemblies 18 and 20 as secured on opposite sides of expansion void 12 while including an expansion joint cover 22 slidably secured thereover. The cover 22 presents an adaptive face 26, i.e. for architectural blending or functional co-action as in the case of a floor surface, as the cover 22 is maintained in continually centered disposition relative to shoulder sub-assemblies 18 and 20. Such expansion joint assemblies are particularly characterized by U.S. Pat. No. 3,183,626 in the name of Schmitt, property of the present assignee. The sub-assemblies 18 and 20 are secured to respective shoulders 14 and 16 by fasteners secured along respective axes 28 and 30. Additional fasteners secured along axes 32 and 34 provide affixure to the fire barrier structure as will be further described below.

A pair of oppositely disposed channel brackets 36 and 38 are secured to respective interior surfaces 40 and 42 of building structure shoulders 14 and 16. The retaining channel member 36 is adapted to secure a sheet portion of barrier 24 adjacent shoulder 14 and includes a right angle bracket 44 secured thereon as by welding to provide a bolt seating for a securing fastener affixed along axis 46. Additional bolt affixure is provided along axis 32 to the sub-assembly 18. On the opposite side, a securing bracket 38 formed with corner angles 38*a* and 38*b* is secured to surface 42 of shoulder 16 along such as axes 48 and/or 50 and an angle bracket (such as bracket 44) may be provided for 45° fasteners. The lower portion of securing channel 38 includes an angle bracket 52 of spring steel welded thereon to expose a retaining flange 54 in spaced relationship from channel edge 38*b* to define a space 56 along the length of channel 38. At assembly, the space 56 is essentially filled with an intumescent fireproof caulking compound for subsequent reception of a rod edge 60 in tight seizure through the spring opening 54.

At the upper edge of channel 38, a spring steel angle tab 62 is secured to channel edge 38*a* as by spot welding and the tab portion extends at an angle of about 30° toward channel 38 while terminating short of a right angle bracket 64 to form a slot opening 66 for receiving a remaining rod edge 68 of barrier 24. The angle bracket 64 is also affixed as by welding to channel 38. In assembly, the void or elongated space 70 formed by angle tab 62 and bracket 64 is filled with caulking compound 58 whereupon rod edge 68 is inserted therein through spring gap 66. A preferred form of caulking compound for use in the elongated spaces 56 and 70 is a flameproof caulking sealant known as METACAULK TM, commercially available from Metalines, Inc. of Oklahoma City, Oklahoma.

The fire barrier 24 consists of a single flexible barrier extending between rod edges 68 and 60 but having a length as required by the length along the expansion void. This may be any length from a very short expansion void to a void that extends on the order of hundreds and even thousands of feet. The width of barrier 24 is dictated by the maximum expansion to be encountered across void 12. Across the width, the barrier 24 consists of rod edge 68 extending into an upper barrier portion 72 of interleaved stainless steel sheet and alumina-silica fiber material which extends into a retainer portion 74 consisting of plural plys of the stainless steel sheeting. Retainer portion 74 then further extends into a plural ply lower barrier portion 76 of plural ply stainless steel sheet and alumina-silica material which finally terminates in rod edge 60. The one piece, multi-segment fire barrier 24 is capable of being handled readily by installment personnel in cramped or elevated spaces thereby to enable quick, permanent affixure in most facile manner.

The upper barrier portion 72 consists of three layers of stainless steel foil 78, 80 and 82 with interspaced alumina-silica paper layers 84 and 86. The stainless steel sheeting may be such as a stainless steel foil, Type 321 Annealed, that is commercially available in specified thicknesses, e.g. 0.002 inches but other thicknesses as specified may be employed. While various types of silica paper or material is available for use as the interspace layers 84 and 86, a recommended type available from The Carborundum Company of Niagara Falls, N.Y., is a type known as FIBERFRAX TM 970 paper consisting essentially of an inorganic blend of $A1_2O_3$ and $SiO_2$ with binder substances.

The lower barrier portion 76 is shown in a three ply configuration. Thus, the stainless steel sheet ply 78 is terminated and secured as by a suitable high temperature bonding agent slightly below the retaining bracket 36 and stainless steel sheets 80 and 82 include an interspaced alumina-silica material 88 across the expansion void. The alumina-silica 88 is of a thicker material, a type of ceramic blanket that exhibits low thermal conductivity and excellent heat strength. A recommended type of material 88 is that known as FIBERFRAX TM, DURABLANKET TM, and alumina-silica fiber watting that is also available from The Carborundum Company. It should be understood that the plys of foil and interspaced fiber sheets may or may not be bonded together and in some cases they may be allowed to seek spaced disposition as an operational advantage. Also, some designs may only call for a single one of the upper or lower barrier portions 72 or 76. It is also contemplated that lead foil be included as required in the event that radiation shielding is also desirable.

Figure 2:
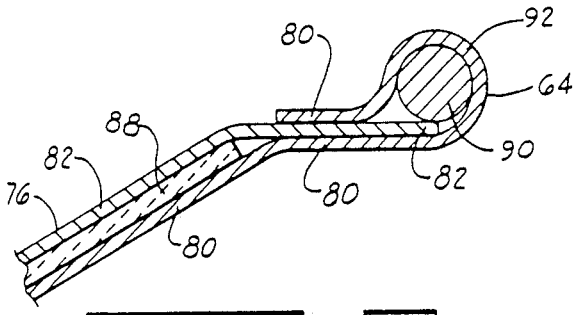
FIG. 2 is a sectional view of a portion of barrier layering in attachment around a securing rod.

Referring also to FIG. 2, the rod edge 60 is formed by wrapping a ply of the stainless steel foil around a rod 90 of selected diameter consonant with the proper coaction with spring opening 54. Thus, the alumina-silica blanket 88 is terminated at a spaced distance from rod 90 whereupon the enveloping stainless steel sheets 82 and 80 are bonded together by a suitable bonding agent while allowing the stainless steel sheet 80 to overlap singularly as an edge portion 92. The edge portion 92 is then tightly wrapped around in bonded affixure to secure the edge rod 90. Edge rod 90 may be any suitable rod stock of the selected diameter; however, a preferred rod material is a braided galvanized wire stock of selected diameter.

Figure 3:
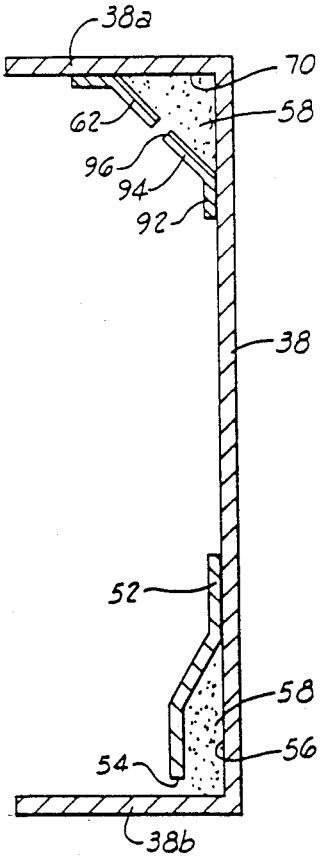
FIG. 3 is a view in section of an alternative form of support plate for utilization in the present invention.

FIG. 3 illustrates an alternative form of securing channel 38 that includes a different form of spring retension device at the upper end. The lower end of securing channel 38 remains the same with an angle bracket 52 welded to define an elongated space 56 accessible through a spring opening 54. The upper end of securing gate 38 is modified in that the right angle bracket 64 (FIG. 1) is replaced by an acute angle bracket 92 secured as by welding and extending an angle portion 94 in-line with angle bracket 62 but defining a spring opening 96. Thus, in assembly the associated rod edge can be easily forced through spring opening 96 for retension within the mass of fireproof caulk 58 while the opposite rod edge is still retained in the same manner through lower spring opening 54. The choice of channel and bracket assemblies reduces to the types and sizes of installations and the ease with which installers can handle the co-acting components, sometimes at precarious positions.

The fire barrier 24 of FIG. 1 illustrates only a single type of barrier combination wherein the upper barrier 72 consists of three stainless steel foil sheets interleaved with two alumina-silica barriers, and the lower portion 76 includes two stainless steel and one alumina-silica layer. The actual spacing between barrier portions 72 and 76 generally responds to a consideration of the amount of air volume contained therebetween; that is, the depth of air space between barrier portions 72 and 76 will be proportional to the expansion gap width between interior structure walls 40 and 42.

Other combinations and numbers of layers of stainless steel foil and alumina-silica may be utilized to better accommodate specific heat and/or expansion characteristics. In the high temperatures around 2,000° F., about eighty percent of heat is radiative and the one or more folds of stainless steel foil contribute most in providing effective barrier through reflectance. At lower temperatures on the order of 300° F. and up, about ninety percent of the heat experienced is convective or conductive and the insulation provided by the alumina-silica paper and/or fabrics contributes most to combatting heat effects. Most of the heat radiation lying in the infrared wavelengths is reflected by the stainless steel sheeting.

Expansion joint assemblies such as that of FIG. 1 are suitable for use in all types of expansion joint applications to provide the fire barrier capability, i.e. the system provides fire and smoke proof integrity at its point of installation in the expansion void. The assembly can be installed with maximum effectiveness in any of floor, ceiling, curtain wall, doorway or other interior applications as well as building exterior applications; however, in curtain wall applications it might be necessary to include an extra layer of stainless steel foil for attachment of thermocouples as used in the standard testing process. That is, a time versus heat test established by the International Conference of Building Officials and carried out with the ASTM No. E119 standards for fire testing.

Figure 4:
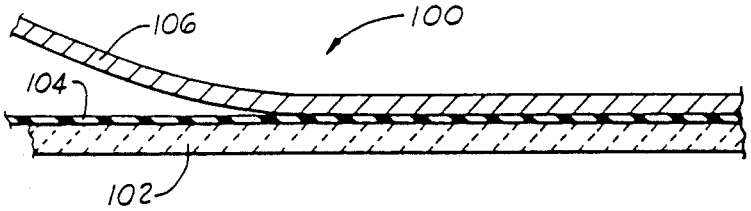
FIG. 4 is a view in section of an alternative form of barrier laminate.

FIG. 4 illustrates an alternative form of barrier laminate 100 that may be employed variously as a flame and smoke barrier, and that may be included in a selected number of layers in combination with such as the expansion joint assembly of FIG. 1. The barrier laminate 100 is formed of a silica fabric 102 that is covered with silicone rubber 104, and further includes a layer of stainless steel foil 106 thereover. The refractory fabric 102 may be a commercially available type known as REFRASIL TM that is coated with the silicone rubber 104 and, thereafter the stainless steel foil 106 is rolled into bonded affixure with the silicone rubber 104. Various types of refractory fabric 102 may be utilized for the underliner as the silicone rubber 104 serves to bond the stainless steel foil 106 thereover.

In operation, the barrier 100 is arrayed with the stainless steel foil 106 directed toward the possible heat or flame source so that its reflectivity makes its greatest contribution in countering the radiative heat energy. The barrier 100 combinations can also be utilized in multiple layers or spaced rows defining dead air spaces in order to provide effective flame and heat integrity.

Figure 5:
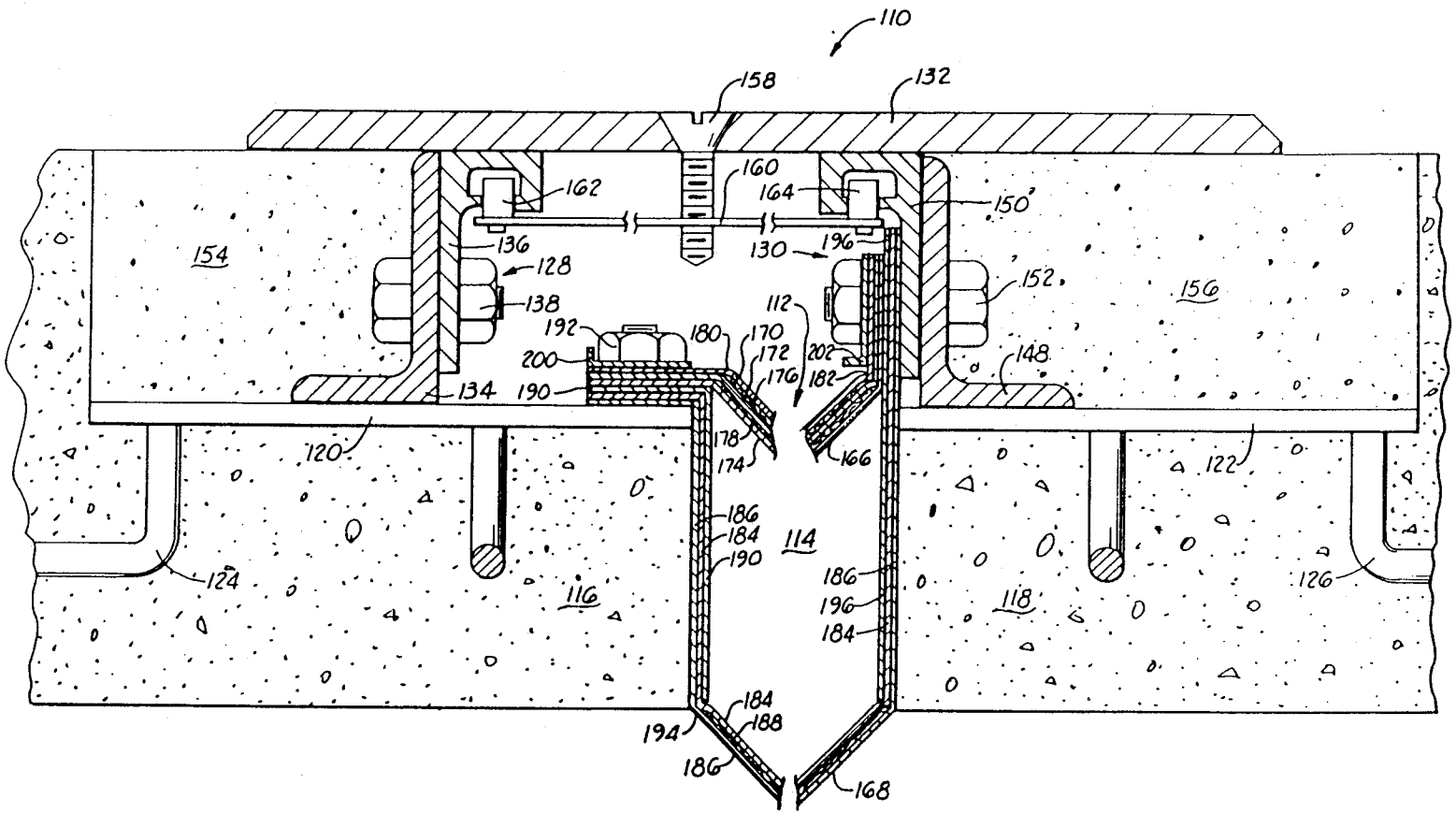
FIG. 5 is a view in vertical section of an alternative form of expansion joint assembly utilizing yet another type of fireproof barrier structure.

FIG. 5 illustrates an alternative form of expansion joint assembly 110 in combination with a fire barrier 112 as disclosed across an expansion void 114. The expansion joint assembly 110 is secured between adjoining deck structures 116 and 118 wherein the opposed shoulder portions have been channeled out to receive oppositely disposed mounting plates 120 and 122 as secured in the deck shoulders by anchor fasteners 124 and 126, respectively. It should be understood that such joint assemblies are necessarily of elongated shape such that the mounting plates 120 and 122 are elongated, and an attendant plurality of anchor bolts 124 and 126 are required along the length of the structure.

Oppositely disposed support sub-assemblies 128 and 130 are then secured to support the centered cover plate 132. Subassembly 128 includes an angle bracket 134 secured as by welding along mounting plate 120 to support a cam guide 136 as affixed therealong by a plurality of bolts 138. In like manner, the opposite side sub-assembly 130 includes an angle bracket 148 supporting a cam guide 150 as secured therealong by a plurality of bolts 152. The deck structure, adjacent the respective subassemblies 128 and 130, is filled in by grout as at 154 and 156. The cover plate 132 is then secured thereover as by bolt fasteners 158, and cover 132 is centrally retained by means of rotatable centering bar 160 and oppositely disposed cam rollers 162 and 164 riding within respective cam guides 136 and 150.

The fire barrier 112 again may consist of an upper barrier 166 and a lower barrier 168 that are separated by a pre-defined distance to provide requisite dead air space therebetween. The upper barrier 166 consists of a plurality of stainless steel sheets with interleaved layers of refractory paper, e.g. alumina-silica paper as before described. Any number of plys of stainless steel foil and refractory material may be selected as barrier 112 illustrates three layers of stainless steel sheeting 170, 172 and 174 and interleaved layers of refractory material 176 and 178. The upper barrier 166 is fold-formed for flexible movement with the refractory material terminating at fold breaks 180 and 182, the stainless steel sheet portions extending to provided securing tab portions. In like manner, the lower barrier 168 consists of a pair of stainless steel sheets 184 and 186 with an interleaved layer of refractory material 188 as the stainless steel ends only extend upward to form securing tabs.

A plurality of securing plates formed of such as 16 gauge sheet metal are utilized to anchor and maintain the barriers 166 and 168 in proper disposition. A right angle securing plate 190 is secured by a bolt 192 to clamp the foil tab ends 184, 186 above a break fold 194. In like manner, a clamping plate 196 is secured as by bolts 152 to retain the opposite sides of stainless steel sheets 184 and 186 adjacent the surface of deck portion 118. The upper stainless steel outer tab portions of upper barrier 166 are retained in similar manner. A clamping plate 200 and bolts 192 secure one side of stainless steel sheeting 170, 172 and 174 while a clamping plate 202 performs the similar function relative to securing bolts 152 on the opposite side.

The embodiment of FIG. 5 again illustrates the combination wherein an upper barrier consists of three layers of stainless steel sheeting with interleaving of two plys of refractory paper, and the lower barrier 168 consists of two layers of stainless steel sheeting including a single ply of refractory blanket material. The paper and/or blanket material may be the FIBERFRAX TM type of material as previously described or other comparable refractory materials. Also, the stainless steel sheeting is preferably a relatively thin stainless steel foil, the weight of the barrier becoming a very important consideration in most applications and especially those wherein handling and installation is required at high altitude or other precarious positions. The barriers 166 and/or 168 may be assembled so that the individual constituent layers are suitably bonded together or they may be non-bonded to allow relative movement each to the other. In same cases it may be desirable for the individual layer components to seek their own relative disposition while providing some interior dead air space.

Figure 6:
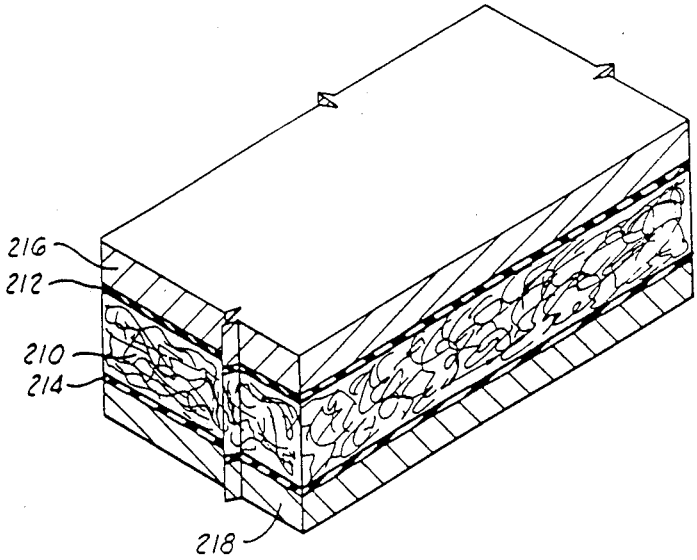
FIG. 6 illustrates in perspective and vertical section a portion of an alternative form of barrier structure.
Figure 7:
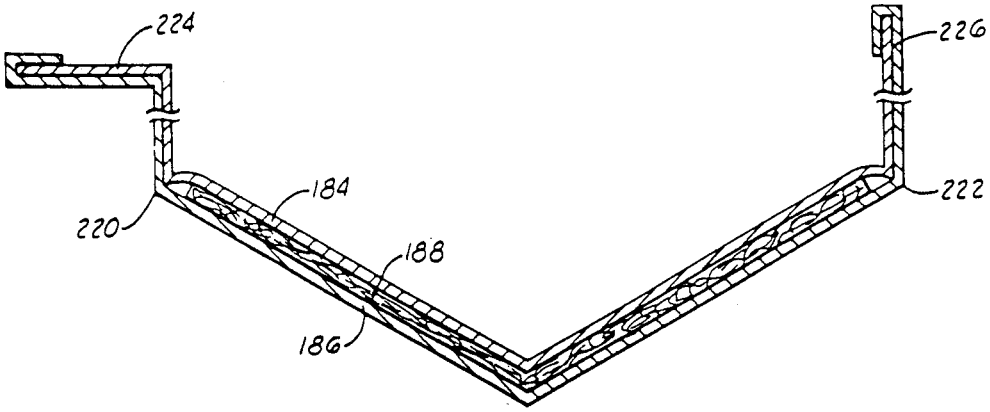
FIG. 7 illustrates in section one form of layering relationship for the flameproof barrier structure as utilized in the invention as exemplified by FIG. 5.

FIG. 6 illustrates in enlarged view a portion of barrier material which amounts to a continuation of the teachings of FIG. 4. That is, an interior refractory material 210, which may be refractory fabric such as REFRASIL ® or other fabric or blanket materials, is hot coated on each side with a silicone rubber coating 212 and 214 and opposite stainless steel foil sheets 216 and 218 are bonded thereon. FIG. 7 illustrates in enlarged form the lower barrier 168 of FIG. 5 wherein the barrier is formed with outer stainless steel sheets 184 and 186 enclosing an inner sheet of refractory blanket 188 that extends only between the fold breaks 220 and 222. The edge or tab portions 224 and 226 of the stainless steel sheets then extend as required for clamping or other affixure across the expansion gap. The edges may be formed with overlap and bonding of one foil sheet relative to the other, e.g. edges of foil sheet 186 are folded over top sheet 184. The plys of the barrier of FIG. 7 may be bonded, as by the silicone rubber coating (FIG. 6) or by other commercially available forms of bonding agent, or the plys may be expressly left unbonded to enable greater flexibility of the barrier.

Figure 8:
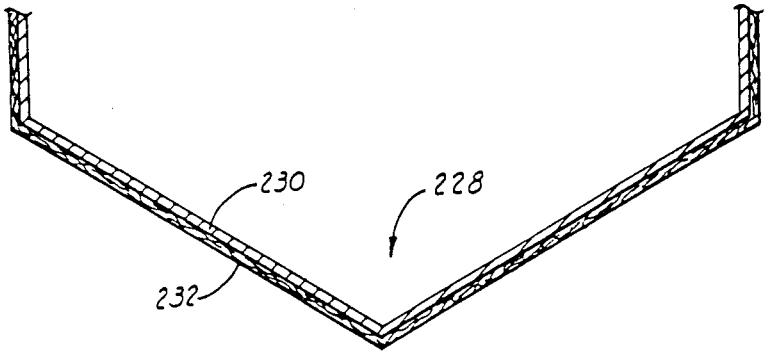
FIG. 8 illustrates in section yet another variation in layering of a flameproof barrier structure.

FIG. 8 illustrates yet another combination, albeit a simplest form of two-ply barrier wherein a sheet of stainless steel foil or sheeting 230 is employed with a layer of refractory or blanket 232. Sheet 230 and layer 232 may or may not be bonded together, and the orientation of the foil side of the barrier will vary in accordance with applications. The two-ply barrier 228 can be effective to provide a high efficiency, light weight, reduced cost heat and flame barrier that is suitable for many construction applications.

Figure 9:
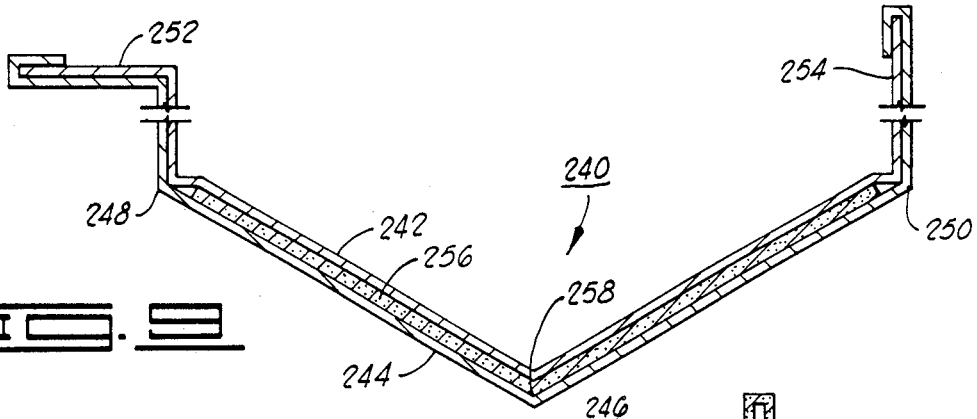
FIG. 9 illustrates in section still another variation in layering of barrier structure including radiation shielding.

FIG. 9 illustrates a reflective heat barrier 240 which also has the capability of blocking high energy radiation or particle flow. This is achieved by maintaining a barrier of lead sheet across the expansion void. Thus, one or more stainless steel foil sheets 242, 244 of requisite width and preselected length, depending upon the length of the expansion void, are disposed across the expansion void 246. Again, the stainless steel foil sheets 242, 244 terminate at respective opposite fold breaks 248 and 250 as the remaining foil is folded into formation of edge or tab portions 252 and 254 which provide affixure to opposed structures. Lead in the form of foil or heavier gauge sheeting 256 is interposed between the stainless steel sheets 242 and 244 to provide radiation absorption. The lead sheet 256 is selected to be of a width sufficient to cover across the expansion void, and to extend lengthwise the requisite amount, while having the capability of flexing as required to accommodate expansive movement. In some cases it may be desirable to provide a seam or other reinforced indention along a central hinge point 258 in order to assure reliable bending through repeated expansion movements. One, two or more stainless steel expansion barriers may be utilized in selected layering while enveloping a plurality of lead sheet members or other insulative material.

Figure 10:
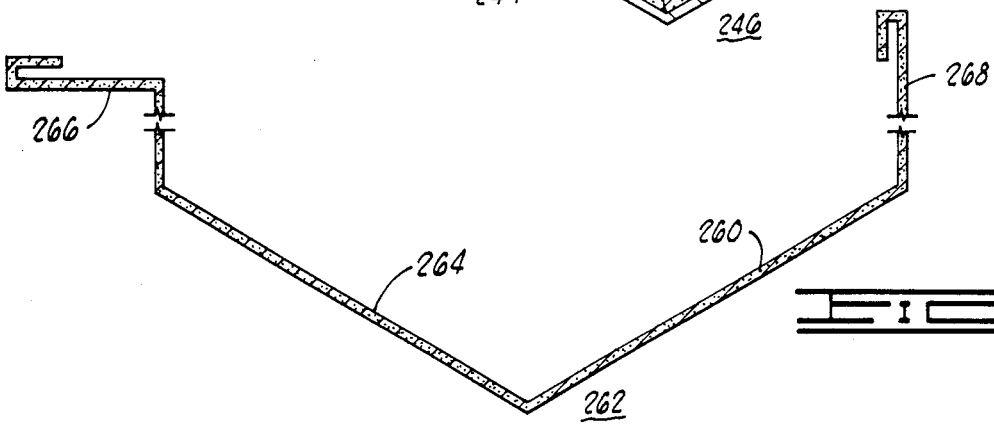
FIG. 10 illustrates another form of radiation resistant expansion void closure.

FIG. 10 illustrates a simple application wherein a single sheet of lead foil 260 is utilized to provide radiation insulation across an expansion void 262. In this case, the lead foil 260 is unitary and forms the central barrier portion 264 as well as edge or tab portions 266 and 268. Here again, such structure is readily combinable with any of various reinforcing barrier structures or heat insulative barrier materials.

Figure 11:
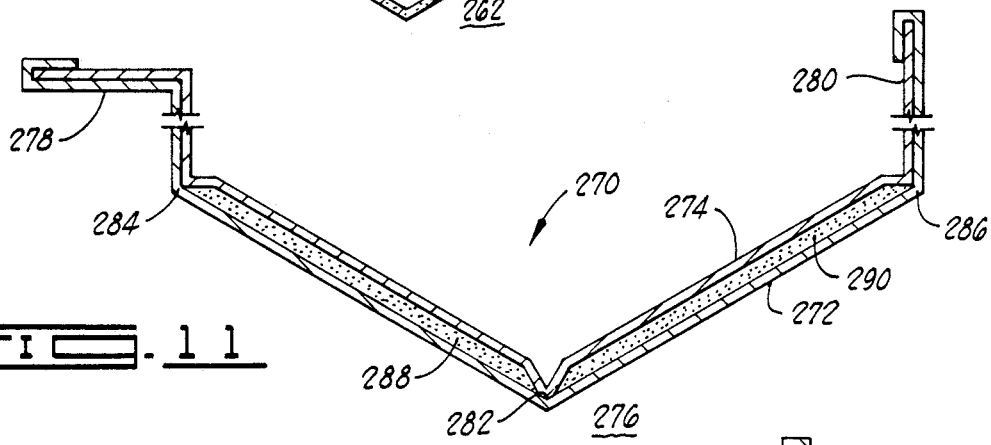
FIG. 11 illustrates in section another alternative of expansion void barrier structure.

Referring now to FIG. 11, an expansion joint barrier 270 is specifically formed for the purpose of maintaining adsorbent material capable of releasing relatively large quantities of water when heated. Thus, this alternative shows a lower stainless steel foil 272 utilized with an upper stainless steel foil 274 that is adapted for forming considerable rectangular volume extending across an expansion void 276. The stainless steel foil sheets 272 and 274 are combined and crimped on opposite sides to provide the edge or tab portions 278 and 280 and the foil may be suitably crimped as at 282 and fold breaks 284, 286 to define barrier volumes containing adsorbent material as at 288 and 290. The adsorbent material may be a fire barrier filler material such as that disclosed in U.S. Pat. No. 4,517,779 as assigned to the present assignee, but it is desirable that the adsorbent material consist of a mixture of sodium silicate liquid with a portion of silica, calcium carbonate and clay which provides an aggregate capable of retaining considerable water per unit volume. Actually, there are several of different types of adsorbent material which retain unduly large quantities of water releasable under heat that might be applied as volumes 288 and 290.

Figure 12:
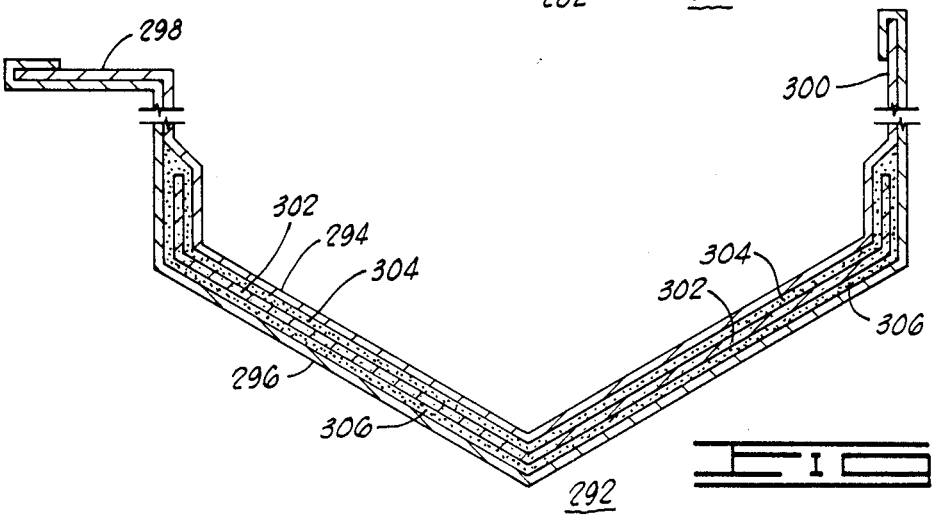
FIG. 12 also illustrates in section still another variation in layering of a flameproof and radiation resistant barrier structure.

Yet another combination of insulation barrier member is shown in FIG. 12 wherein a combination of radiation protective and heat protective substances is utilized. Thus, an expansion void 292 is closed over by parallel-disposed stainless steel foil sheets 294 and 296 which are terminated in the edge or tab portions 298 and 300. Lead 302 foil or sheeting is then inserted between the stainless steel sheets 294, 296 in such configuration and to such extent as required by the exigencies of the application. And spaces on each side of lead 302 are filled with a caulking compound as at upper and lower spaces 304, 306. A suitable caulking compound is an intumescent, silica-base caulking compound which is the subject matter of co-pending U.S. Pat. Application Ser. No. 778,853, filed concurrently with the parent of the present application. The expansion barrier in this case provides radiation shielding by means of lead foil 302, heat radiation shielding by means of stainless steel outer foil 294, 296, and the intumesence of caulking compounds 304, 306 under the influence of heat assures a dead air space throughout the central portion of the expansion barrier on each side of the lead foil 302.

The foregoing discloses a novel combination of expansion joint assembly with fire and smoke barrier, radiation barrier and combinations thereof. The barrier utilizes various combinations of stainless steel foil and lead foil with layers of refractory material, i.e. papers, fabrics and blanket materials, thereby to provide an extremely versatile flame, heat and smoke barrier that is light in weight, easy to install and much reduced in cost in relation to the benefits derived and comparable structure. It should be understood that Applicants do not intend in any way to limit the obvious versatility of the invention. That is, the combinations or plys of stainless steel and lead sheeting and refractory material, and their particular stacking or combining, may be varied over a wide range of possible combinations to achieve specifically desirable fire and radiation barrier effects whether it be from the safety standpoint, the cost effectiveness standpoint or ease of installation.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for insulative enclosure of an expansion void between first and second structures, comprising:

a sheet of stainless steel foil having first and second edges and being of preselected length and a width at least as great as said expansion void;

means for securing said first and second edges to said first and second structures; and a sheet of lead of uniform thickness secured in flexurally coordinated juxtaposition adjacent said sheet of stainless steel foil.

2. Apparatus as set forth in claim 1 which further includes:

a uniform thickness layer of heat resistant silica caulking material that exhibits intumescence upon extreme heating.

3. Apparatus as set forth in claim 1 which further includes:

a second sheet of stainless steel foil having first and second edges, said second sheet overlying said first sheet and enveloping said sheet of lead.

4. Apparatus as set forth in claim 5 which further includes:

a uniform thickness layer of heat barrier adsorbent material containing a predetermined amount of water in retention.

5. Apparatus as set forth in claim 4 wherein:

said adsorbent material is a layer of heat resistant silica caulking material that exhibits intumescence upon extreme heating.

6. Apparatus for cover of an expansion void between first and second structures, comprising:

first and second support structure secured to said first and second structures on respective sides of said expansion void;

cover means slidably retained to enclose said first and second support structures;

at least one sheet of stainless steel foil having first and second edges and being of preselected length and a width at least as great as said expansion void, said foil being secured at said first and second edges to the respective first and second building structures; and a sheet of lead secured in flexurally coordinated juxtaposition adjacent said sheet of stainless steel foil.

7. Apparatus as set forth in claim 6 which further includes:

a uniform thickness layer of heat barrier adsorbent material containing a predetermined amount of water in retention.

* * * * *

UNITED STATES PATENT AND TRADEMARK OFFICE

CERTIFICATE OF CORRECTION

PATENT NO. : 4,967,527

DATED : November 6, 1990

INVENTOR(S) : Henry J. Gohlke

It is certified that error appears in the above-identified patent and that said Letters Patent is hereby corrected as shown below:

Column 10, line 9:
In claim 4, line 1, delete the numeral "5" and substitute the numeral --3-- therefor.

Signed and Sealed this

Seventeenth Day of March, 1992

*Attest:*

HARRY F. MANBECK, JR.

*Attesting Officer*

*Commissioner of Patents and Trademarks*